US012076620B2

(12) United States Patent
Ogawa

(10) Patent No.: US 12,076,620 B2
(45) Date of Patent: Sep. 3, 2024

(54) GROMMET AND RACKET

(71) Applicant: YONEX CO., LTD., Tokyo (JP)

(72) Inventor: Naoto Ogawa, Niigata (JP)

(73) Assignee: YONEX CO., LTD., Tokyo (JP)

( * ) Notice: Subject to any disclaimer, the term of this patent is extended or adjusted under 35 U.S.C. 154(b) by 479 days.

(21) Appl. No.: 17/435,240

(22) PCT Filed: Mar. 6, 2020

(86) PCT No.: PCT/JP2020/009757
§ 371 (c)(1),
(2) Date: Aug. 31, 2021

(87) PCT Pub. No.: WO2020/184453
PCT Pub. Date: Sep. 17, 2020

(65) Prior Publication Data

US 2022/0134191 A1 May 5, 2022

(30) Foreign Application Priority Data

Mar. 8, 2019 (JP) ..... 2019-042725

(51) Int. Cl.
*A63B 49/022* (2015.01)

(52) U.S. Cl.
CPC ..... *A63B 49/022* (2015.10)

(58) Field of Classification Search
CPC .... A63B 49/022; A63B 51/001; A63B 51/004
See application file for complete search history.

(56) References Cited

U.S. PATENT DOCUMENTS 5,092,016 A * 3/1992 Soong ..... A63B 49/022 473/539
5,332,213 A * 7/1994 Klose ..... A63B 49/022 473/522

(Continued)

FOREIGN PATENT DOCUMENTS

BE 1003034 A7 * 3/1989
JP 2012-517873 8/2012

(Continued)

OTHER PUBLICATIONS

Extended European Search Report Issued in Corresponding EP Patent Application No. 20769356.5, dated Oct. 11, 2022.

(Continued)

*Primary Examiner* — Joshua T Kennedy
(74) *Attorney, Agent, or Firm* — GREENBLUM & BERNSTEIN, P.L.C.

(57) ABSTRACT

Repulsive-performance upon ball hitting with a racket is enhanced, and good feeling of ball hitting is ensured. A grommet includes a cylindrical part which is mounted pierced through a through hole formed in a frame of a racket and through which a string passes. The string is extended in a tensioned state on the frame and deflected with one end side of the cylindrical part as a deflection position. The cylindrical part includes a first formation section located on a deflection-position side with reference to a central axis position of an outer peripheral face of the cylindrical part and a second formation section located on an opposite side of the central axis position from the first formation section. The first formation section has a greater thickness than the second formation section in a radial direction of the cylindrical part.

5 Claims, 5 Drawing Sheets

(56) References Cited

U.S. PATENT DOCUMENTS

| | | | | |
|---|---|---|---|---|
| 5,993,337 | A * | 11/1999 | Janes | A63B 60/00 473/539 |
| 6,336,877 | B1 * | 1/2002 | Arroyo | A63B 49/022 473/522 |
| 8,951,150 | B2 * | 2/2015 | Mace | A63B 49/038 473/522 |
| 2009/0017948 | A1 * | 1/2009 | Ashino | A63B 49/022 473/522 |
| 2010/0331126 | A1 * | 12/2010 | Lizawa | A63B 49/02 473/539 |
| 2013/0274038 | A1 * | 10/2013 | Chang | A63B 49/022 473/557 |
| 2015/0157902 | A1 * | 6/2015 | Mohr | A63B 49/022 473/539 |
| 2017/0173407 | A1 * | 6/2017 | Ogawa | A63B 49/022 |
| 2018/0078828 | A1 * | 3/2018 | Valbousquet | A63B 49/022 |
| 2018/0369656 | A1 * | 12/2018 | Kawabata | A63B 51/10 |
| 2020/0298069 | A1 * | 9/2020 | Yamamoto | A63B 49/022 |
| 2022/0134190 | A1 * | 5/2022 | Kawabata | A63B 49/022 473/539 |
| 2022/0134191 | A1 * | 5/2022 | Ogawa | A63B 60/54 473/539 |
| 2023/0141640 | A1 * | 5/2023 | Mimura | A63B 51/02 473/539 |

FOREIGN PATENT DOCUMENTS

| | | | |
|---|---|---|---|
| JP | 2018-89153 | | 6/2018 |
| JP | 2018089153 | A * | 6/2018 |

OTHER PUBLICATIONS

Internation Search Report for WIPO Patent Application No. PCT/JP2020/009757, dated Apr. 28, 2020, along with an English translation thereof.

* cited by examiner

GROMMET AND RACKET

TECHNICAL FIELD

The present invention relates to a grommet to be mounted on a racket frame so as to prevent a string and the frame from being in contact with each other, and to a racket using the grommet.

BACKGROUND ART

As disclosed in patent document 1, tennis rackets and badminton rackets are provided with a loop-shaped frame and have a hitting face (a face) formed by extending a string in a tensioned state inside the frame. The frame has formed therein many holes which are arranged at certain spacings and through which the string is inserted. Grommets are mounted in the holes, and cylindrical portions (hereinafter, "cylindrical parts") of the grommets are positioned between the inner circumferential faces of the holes and the string so as to prevent the inner circumferential faces and the string from being in contact with each other.

PRIOR ART DOCUMENT

Patent Document

Patent Document 1: Japanese National Publication of International Patent Application No. 2012-517873

SUMMARY OF THE INVENTION

Problems to be Solved by the Invention

A grommet includes circular cylindrical parts, and the circular cylinders have a uniform thickness in the radial direction thereof. When a ball is hit by the racket, the grommet is deformed by receiving a force resulting from flexure of the string, and a restoring force after the deformation acts not only on the string but also on the ball contacting the string.

The inventor found that decreasing the thickness of the cylindrical parts will increase the amounts of deformations of the string and the cylindrical parts upon ball hitting and thus enhance the ball repulsive-performance and that increasing the thickness of the cylindrical parts will decrease the amounts of deformations and thus reduce the repulsive-performance. In addition, the inventor found that increasing the thickness of the cylindrical parts with the inner circumferential faces thereof in contact with the string will suppress unnecessary vibrations caused by the string upon ball hitting and thus improve the feeling of ball hitting and that decreasing the thickness of the cylindrical parts will make it difficult to suppress such noise vibrations. Thus, there is a relationship of trade-off between the enhancement of the ball repulsive-performance associated with the thickness of the cylindrical parts and the improvement in the feeling of ball hitting. However, through keen analysis, the inventor arrived at an invention that allows both the repulsive-performance and the feeling of ball hitting to be improved.

The present invention was created in view of such a fact, and an object thereof is to provide a grommet and a racket that can enhance the repulsive-performance upon ball hitting with the racket and ensure good feeling of ball hitting.

Means for Solving Problems

A grommet in one aspect of the present invention includes a cylindrical part which is mounted pierced through a hole formed in a frame of a racket and through which a string passes, wherein the string is extended in a tensioned state on the frame and deflected with one end side of the cylindrical part as a deflection position, the cylindrical part includes a first formation section located on a deflection-position side with reference to a central axis position of an outer peripheral face of the cylindrical part and a second formation section located on an opposite side of the central axis position from the first formation section, and the first formation section has a greater thickness than the second formation section in a radial direction of the cylindrical part.

In accordance with this configuration, the second formation section, which is not in contact with the deflected string, can have a less thickness than the first formation section, which is in contact with the deflected string. Owing to the second formation section having the reduced width, large amounts of deformations of the cylindrical part and the string can be ensured when a ball is hit, thereby enhancing the repulsive-performance. Moreover, owing to the first formation section in contact with the string having the increased thickness, noise vibrations that could be caused by the string upon ball hitting can be suppressed, and an unpleasant feeling can be prevented from being transferred, thereby improving the feeling of ball hitting. In this way, with the above configuration, the effect of the enhancement of the repulsive-performance and the effect of the improvement in the feeling of ball hitting, i.e., effects that would have a relationship of trade-off, can be concurrently achieved.

In the grommet of the present invention, the cylindrical part, when viewed in a direction in which a central axis thereof extends, may include a circular inner edge and a circular outer edge, and a central axis position of the inner edge may be positioned on an opposite side of a central axis position of the outer edge from the deflection position, so as to form the first and second formation sections. In accordance with this configuration, with the cylindrical part having a simple and non-complicated shape, the cylindrical part can be formed such that the first formation section has a greater thickness than the second formation section.

In the grommet of the present invention, the first formation section may be formed from a different material from the second formation section. In accordance with this configuration, the first and second formation sections are different in material and thus can each have a different rigidity, so that the repulsive-performance and the feeling of ball hitting can be varied according to the thickness of the cylindrical part as well as the materials therefor.

In the grommet of the present invention, the first and second formation sections may each have a different length in an axis line direction of the cylindrical part. In accordance with this configuration, the lengths of the first and second formation sections are different, so that the repulsive-performance and the feeling of ball hitting can be varied.

The grommet of the present invention may further include a plurality of the cylindrical parts and a band-like part that couples the plurality of cylindrical parts and extends in a certain direction, wherein positions at which the first and second formation sections of the plurality of cylindrical parts are formed may be different in an alternating pattern in a direction in which the band-like part extends. In accordance with this configuration, first and second formation sections can be formed in the plurality of cylindrical parts according to the stringing direction in which the string meanders. Accordingly, the plurality of cylindrical parts can be the same in terms of the positional relationship between the deflection position of the string and the first and second formation sections, and a plurality of strings, i.e., a wide hitting face, can attain an enhanced repulsive-performance and improved feeling of ball hitting owing to the cylindrical parts.

A racket in one aspect of the present invention includes: the grommet, which includes a plurality of said cylindrical parts; and a frame on which strings are extended in a tensioned state in a longitudinal direction and a lateral direction, wherein the cylindrical parts are pierced through holes formed in the frame, so as to mount the grommet on the frame, and the strings are extended in a tensioned state by being passed through the plurality of cylindrical parts.

In the racket of the present invention, the first and second formation sections may be formed in each of cylindrical parts, among the plurality of cylindrical parts, through which the string extended in a tensioned state in the longitudinal direction is inserted. In accordance with this configuration, the string in the longitudinal direction, which largely affects the repulsive-performance and the feeling of ball hitting, can achieve the above-described effects efficiently.

In the racket of the present invention, the first and second formation sections may be formed in each of cylindrical parts through which the strings passing through a central region of the frame are inserted. In accordance with this configuration, the ball hitting performance of the strings forming a so-called sweet spot can achieve the above-described effects efficiently.

Effect of the Invention

In the present invention, the first formation section on the string-deflection-position side has a greater thickness than the second formation section, so that the repulsive-performance upon ball hitting with the racket can be enhanced and good feeling of ball hitting can be ensured.

Figures 1A, 1B:
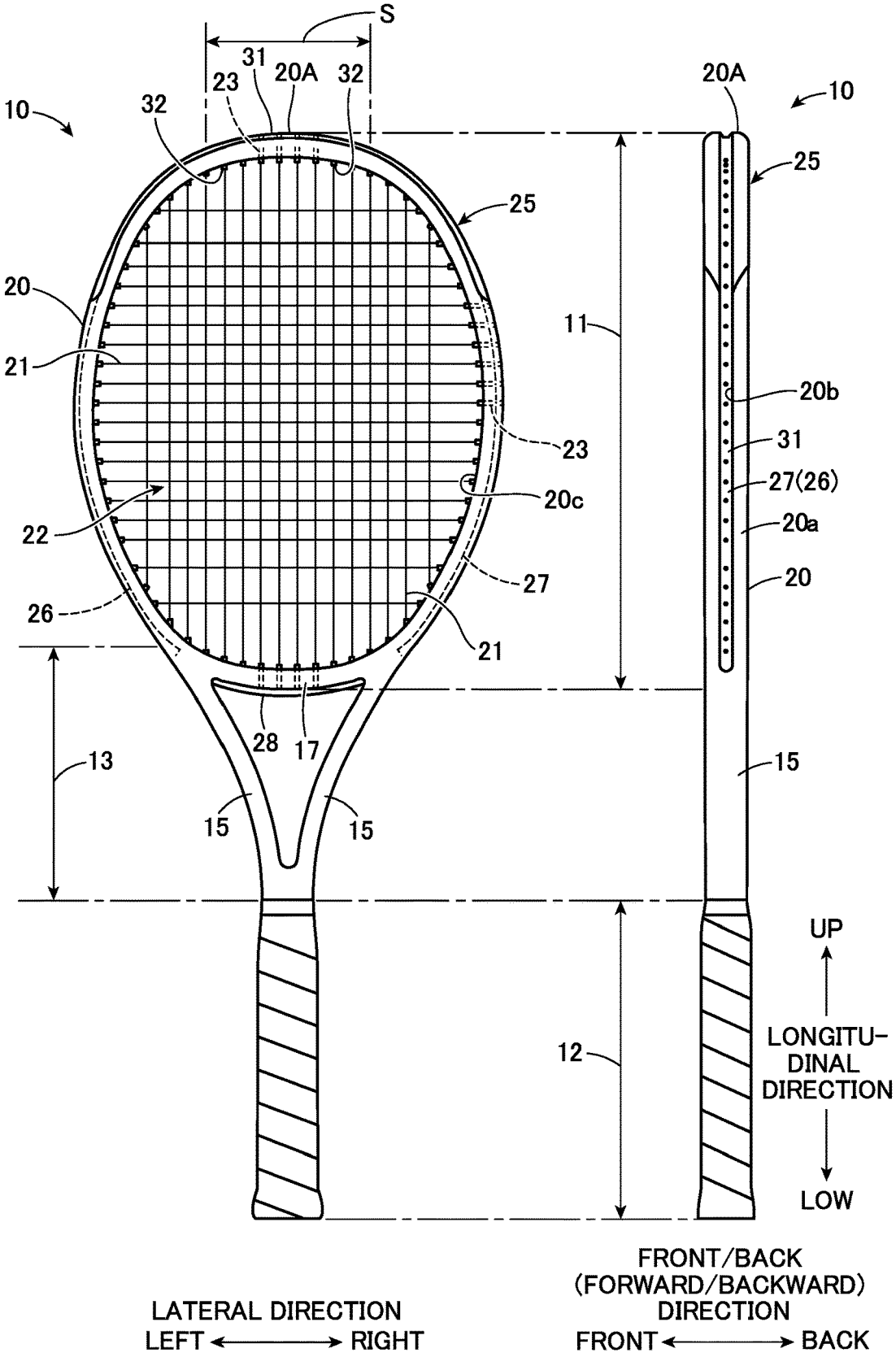
FIGS. 1A and 1B are appearance views of a racket in accordance with embodiments, FIG. 1A being a front view of the racket, FIG. 1B being a side view of the racket.

The following specifically describes embodiments of the present invention by referring to the drawings. Although the following descriptions are given for examples in which the grommet of the present invention is applied to a tennis racket, the application of the grommet is not limited to this and can be changed. For example, the grommet may be applied to a soft tennis racket, a squash racket, or a badminton racket.

FIG. 1 is an appearance view of a racket in accordance with embodiments of the present invention, FIG. 1A being a front view of the racket, FIG. 1B being a side view of the racket. Note that indications of some components are omitted for descriptive purposes in the drawings described in the following.

As depicted in FIG. 1, a racket 10 includes: a head 11, i.e., a site for hitting a ball; a grip 12, i.e., a site to be gripped by a player to hold the racket 10; and a shaft 13 integrally coupling the head 11 and the grip 12. In the following descriptions, as indicated by arrows in FIG. 1, the longer direction of the racket 10 is defined as a longitudinal direction, the side in the longitudinal direction on which the head 11 is located is defined as an upper side, and the side in the longitudinal direction on which the grip 12 is located is defined as a lower side. A direction orthogonal to the longitudinal direction on a hitting face 22 of the racket 10 (i.e., on a plane along the hitting face 22) is defined as a lateral direction (or a left-right direction). A direction orthogonal to the hitting face 22 of the racket 10 is defined as a front/back direction (or a forward/backward direction). The near side of the plane of FIG. 1A (left side of the plane of FIG. 1B) is defined as a front side, and the opposite side from the front side is defined as a back side.

When seen in the front/back direction, the shaft 13 includes throats 15 constituted by two branches extending from the grip 12 toward the head 11. A yoke 17 forming a portion of the head 11 is formed between the left and right throats 15. The yoke 17 forms a lower side of a frame 20 (described hereinafter). The shaft 13 is not limited to this and may not include two branches.

The head 11 includes an oval frame 20 that is long in the longitudinal direction, and strings 21 that are extended inside the frame 20 in a tensioned state in the longitudinal direction and the lateral direction. The strings 21 form hitting faces (faces) 22 on both of the front and back sides of the inside of the frame 20. For example, the frame 20 may be provided by forming a cylindrical hollow body formed from fiber-reinforced plastic into an oval shape. Alternatively, the frame 20 may not be a hollow body but may be filled with a foam material, or may be a wooden or metal body.

An outer peripheral face 20*a* of the frame 20 includes a groove section 20*b* formed by a central portion of the outer peripheral face 20*a* in the front/back direction being recessed relative to both side portions thereof. The groove section 20*b* is continuously provided in the circumferential direction of the frame 20. The frame 20 includes through holes (holes) 23. The through holes 23 extend in a pierced manner from the bottom side of the groove section 20*b* of the frame 20 to an inner circumferential face 20*c* of the frame 20. The through holes 23, i.e., a plurality of through holes, are arranged in the circumferential direction of the frame 20.

Figure 2:
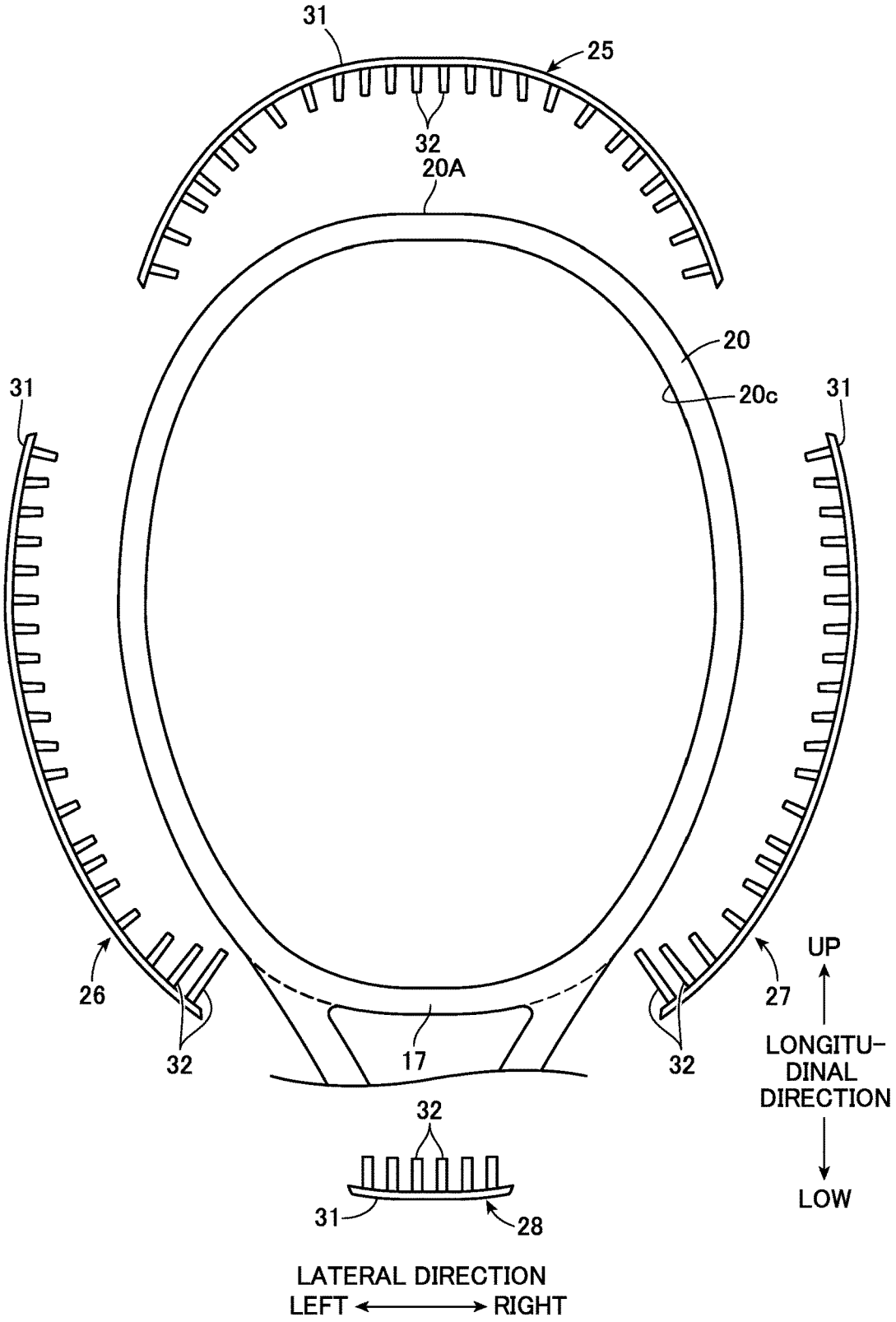
FIG. 2 is an explanatory front view of a situation in which grommets have been removed from a frame.

FIG. 2 is an explanatory front view of a situation in which grommets have been removed from the frame. Four grommets 25-28 are mounted, as indicated in FIG. 2, onto the frame 20 from the outer-edge side, and strings 21 are extended in a tensioned state on the frame 20 via the grommets 25-28. In the present embodiment, the grommet 25 on the upper side extends, with reference to the front view of the frame 20 in FIG. 2, from a site of approximately 10 o'clock to a site of approximately 2 o'clock and protects the portion of the frame 20 on a top-20A side. The left and right grommets 26 and 27 are respectively provided extending from the vicinities of the left and right end portions of the grommet 25 on the upper side to positions reaching the lowermost through holes 23 formed in the left and right side faces of the frame 20. The grommet 28 on the lower side is provided on the yoke 17. The lengths of the grommets 25-27, i.e., the grommets other than the grommet 28 on the lower side, in the circumferential direction of the frame 20 may be varied in accordance with various conditions.

As an example, the grommets 25-28 may each be a molded product obtained through injection molding with thermoplastic. The grommets 25-28 each include a band-like part 31 extending in the circumferential direction of the frame 20 and a plurality of cylindrical parts 32 protruding from a back face of the band-like part 31, i.e., one face of the band-like part 31. The band-like part 31 has a forward-backward width that is greater than or equal to that of the groove section 20*b* and less than that of the frame 20. The band-like part 31 of the grommet 25 on the upper side has a forward-backward width substantially equal to that of the frame 20 and protects the top-20A side of the frame 20.

The cylindrical parts 32 each include a base section on the band-like-part-31 side and a leading-end section on an opposite side from the base section, and the leading-end sections are pierced through the through holes 23 from outside the frame 20. The piercing causes the grommets 25-28 to be mounted on the frame 20, with the leading-end sides of the cylindrical parts 32 disposed protruding inward from the inner-circumferential-face-20*c* side of the frame 20. An inner space of each of the cylindrical parts 32 is formed as an insertion path 33 (see FIG. 3) through which a string 21 is inserted. The inner diameter of the insertion path 33 is larger than the diameter of the string 21 for ease of the task of passing the string 21 through the insertion path 33.

Figure 3:
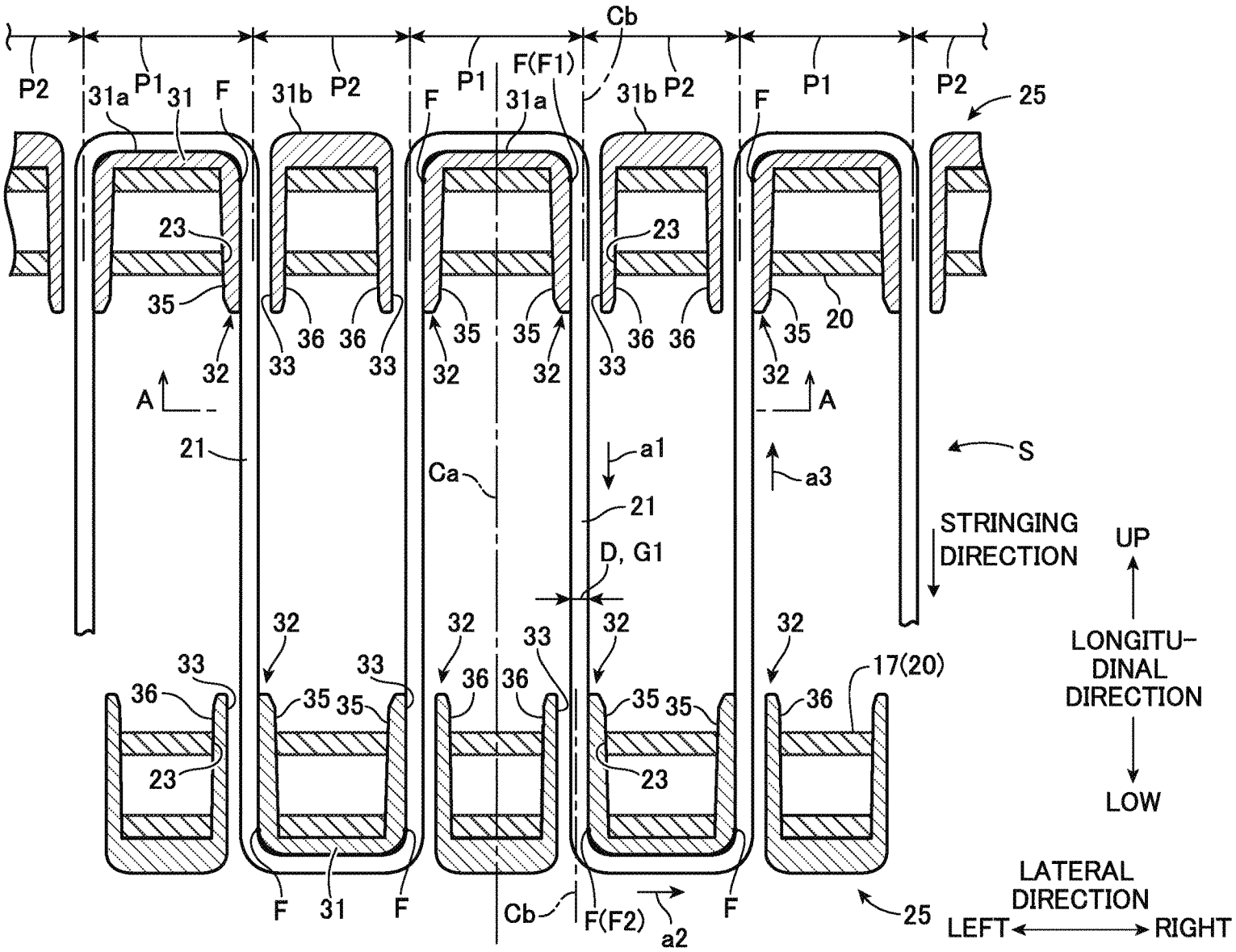
FIG. 3 is a partial cross-sectional front view of a racket that schematically illustrates a state in which a string is extended in a tensioned state in embodiments.

Next, by referring to FIG. 3, descriptions are given of a procedure for extending a string 21 in a tensioned state in the present embodiment. FIG. 3 is a partial cross-sectional front view of a racket that schematically illustrates a state in which a string is extended in a tensioned state in embodiments. The following describes a procedure for extending a string 21 in a tensioned state in the longitudinal direction within a sweet spot forming a central region of the frame 20, i.e., a main string 21 forming longitudinal lines within a central region S (see FIG. 1).

As depicted in FIG. 3, when a main string 21 for forming longitudinal lines is extended in a tensioned state on the frame 20, the string is, when seen from, for example, the position and direction of an arrow a1, inserted from the leading-end side of a cylindrical part 32 toward the base section thereof. The string 21 is deflected on one base section (one end side) of the cylindrical part 32 and extends outside the frame 20 along the face of the band-like part 31 in accordance with the position and direction of an arrow a2. Then, the string 21 is deflected on another base section of the cylindrical part 32 adjacent to the one base section in the lateral direction, is inserted from the base-section side of the cylindrical part 32 toward the leading end thereof in accordance with the position and direction of an arrow a3, and extends inside the frame 20 in the longitudinal direction.

Such a procedure is performed in an alternating pattern on the lower and upper sides of the frame 20 with one main string 21 for forming longitudinal lines. In this way, the main string 21 for forming longitudinal lines extends in the lateral direction while meandering by being repeatedly inserted and deflected in association with the insertion paths 33 in a plurality of cylindrical parts 32. The direction in which the string 21 extends, including the directions of the arrows a1-a3, are defined as a stringing direction for the string 21.

Next, positions at which the cylindrical parts 32 are formed are described in the following. First, descriptions are given of an insertion path through which the main string 21 for forming longitudinal lines within the central region S is extended in a tensioned state.

In the present embodiment, cylindrical parts 32 through which upper and lower sides of a longitudinal line of the main string 21 are inserted are formed at asymmetric positions and have asymmetric shapes, with the lateral direction as a symmetric axis position. For example, for the initial longitudinal line (main string 21) that is positioned to the right of a central position Ca of the central region S in the left-right direction, the cylindrical part 32 on the lower side is offset from the cylindrical part 32 on the upper side in the lateral direction toward the central position Ca. A deflection position is located on the left side of the base section of the upper cylindrical part 32 (one cylindrical part 32) through which the longitudinal line (main string 21) is inserted (e.g., located at a position indicated by symbol F1 in FIG. 3). Meanwhile, a deflection position for the string 21 is located on the right side of the base section of the lower cylindrical part 32 (another cylindrical part 32) (e.g. located at a position indicated by symbol F2 in FIG. 3). The deflection positions F1 and F2 are offset from each other in the lateral direction, and the offset amount G1 is substantially equal to a diameter D of the string 21. Accordingly, the main string 21 for forming longitudinal lines is extended in a tensioned state so as to be parallel to or substantially parallel to the longitudinal direction, in particular, extended in a tensioned state so as to form a tilt angle falling within a range from 0 degrees to 0.2 degrees with the longitudinal direction of the string 21. Note that the offset amount G1 and diameter D being substantially equal means that these two are equal or are different to the extent that the tilt angle falls within the noted range.

Grooves 31*a* are formed in regions of a face of the band-like part 31 along which the string 21 extends, and regions thereof along which the string 21 does not extend are defined as non-formation regions 31*b*, in which no grooves 31*a* are formed.

Figure 4:
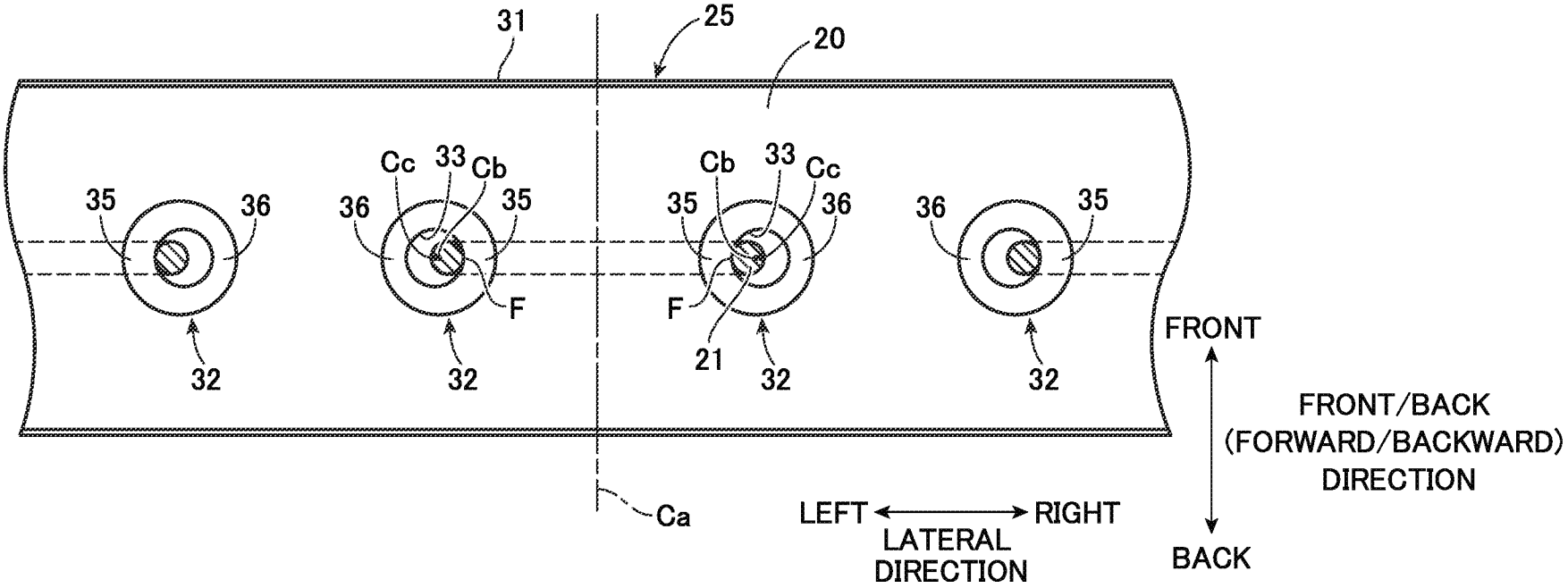
FIG. 4 is an A-A line cross-sectional view of FIG. 3.

Next, the specific configuration of the cylindrical part 32 is described by referring to FIGS. 3 and 4. Unless otherwise indicated, a region in the cylindrical part 32 that is located on the deflection-position-F (F1, F2) side with reference to a central axis position Cb of the outer peripheral face of the cylindrical part 32 is defined as a first formation section 35 herein and in the claims. A region located on an opposite side of the central axis position Cb from the first formation section 35 is defined as a second formation section 36. Accordingly, as an example, the cylindrical part 32 may be formed from the first formation section 35 and the second formation section 36, and the position of boundary (boundary plane) between the first formation section 35 and the second formation section 36 may be a plane that includes the central axis position Cb and extends in the front/back direction (direction orthogonal to the plane of FIG. 3). The position of boundary is not limited to this and may be set such that the central axis position Cb is slightly shifted in the front/back direction or such that the first formation section 35 and the second formation section 36 are separated in the front/back direction.

FIG. 4 is an A-A line cross-sectional view of FIG. 3. FIG. 4 is seen in the direction in which the central axis position Cb of the cylindrical part 32 extends (direction orthogonal to the plane of the figure). As depicted in FIG. 4, the cylindrical part 32 includes a circular outer edge and a circular inner edge forming the insertion path 33, and a central axis position Cc of the inner edge does not match the central axis position Cb of the outer edge and is offset therefrom in the lateral direction toward an opposite side from the deflection position F. Thus, the inner and outer edges of the cylindrical part 32 have a positional relationship of eccentricity in the lateral direction, and the thickness of the cylindrical part 32 in the radial direction varies between the two sides of the central axis direction Cb in the lateral direction. With such a configuration, the portion of the cylindrical part 32 that has the greater thickness in the radial direction is defined as a first formation section 35, and the portion thereof that has the less thickness in the radial direction is defined as a second formation section 36. In other words, the first formation section 35 of the cylindrical part 32, which is located on the deflection-position-F side, has a greater thickness in the radial direction of the cylindrical part 32 than the second formation section 36, which is located on an opposite side from the first formation section 35.

The string 21 is extended in a tensioned state in a meandering manner, so when cylindrical parts 32 adjacent to each other in the left-right direction are compared, it is found that the deflection positions F therein for the string 21 are located on opposite sides in the left-right direction. In this regard, the band-like part 31 extends in the lateral direction in the regions in which the cylindrical parts 32 through which the main string 21 for forming longitudinal lines is extended in a tensioned state are formed, so a plurality of cylindrical parts 32 are formed such that the positions at which first formation sections 35 and second formation sections 36 are formed are different in an alternating pattern in the lateral direction. Thus, in each of the plurality of cylindrical parts 32, the first formation section 35 is substantially in line-contact with the string 21 extending from the deflection position F to the inside of the frame 20.

The racket 10 in the present embodiment includes a plurality of cylindrical parts 32 for each of the grommets 25-28. The cylindrical parts 32 that include first formation sections 35 and second formation sections 36 are among the plurality of cylindrical parts 32.

In a specific example, the cylindrical parts 32 that include first formation sections 35 and second formation sections 36 are cylindrical parts 32 through which the main string 21 for forming longitudinal lines is inserted. Among the cylindrical parts 32, cylindrical parts 32 through which the string 21 passing through the central region S is inserted may include first formation sections 35 and second formation sections 36. In particular, in the case of a main string 21 forming 16 longitudinal lines, cylindrical parts 32 through which 12-14 longitudinal lines (main string 21) in the center in the left-right direction are inserted may include first formation sections 35 and second formation sections 36. When some of the plurality of cylindrical parts 32 include first formation sections 35 and second formation sections 36, the central axis positions of the inner and outer edges of each of the other cylindrical parts 32 match each other, and each of the other cylindrical parts 32 has a uniform thickness in the circumferential direction.

When a ball is hit by the racket 10 in the present embodiment, the string 21 extended in a tensioned state in the longitudinal direction is flexed by receiving forces in the front/back direction and the lateral direction. The cylindrical parts 32 of the upper and lower grommets 25 and 28 receive a force and are thus deformed due to the flexure of the string 21, and a restoring force after the deformation acts on the string 21. Thus, both the force of the string 21 restoring from a flexed state and the restoring force of the cylindrical parts 32 act on the ball, and the ball is repulsively hit with spin by receiving the forces. The cylindrical part 32 includes a second formation section 36 having a decreased thickness, so that the amount of motion (deformation) of the cylindrical part 32 can be increased owing to flexure of the string 21, thereby increasing the elastic force of the cylindrical part 32 when the cylindrical part 32 is restored after being moved. In this way, the elastic force of the cylindrical part 32, which is transferred to the ball via the string 21, can be increased so as to increase the repulsive force applied to the ball and the spin rate thereof, thereby enhancing ball hitting performances such as the repulsive-performance and the spin performance.

The deflected string 21 is in contact with the inner face of the first formation section 35 in the cylindrical part 32, and when a force that could vibrate the string 21 is generated upon ball hitting, the first formation section 35 can suppress generation of such vibrations. In the cylindrical part 32, the first formation section 35, which forms a region in contact with the string 21, has a great thickness, so that a strong effect of suppressing vibrations of the string 21 can be achieved. Accordingly, unnecessary vibrations, which would be unpleasant for the player, can be prevented from being generated, so the feeling of ball hitting is not reduced.

In such an embodiment, the cylindrical part 32 includes the first formation section 35 and the second formation section 36, so that, as indicated above, both the enhancement of ball hitting performances such as the repulsive-performance and the spin performance and the improvement of the feeling of ball hitting can be attained in a balanced manner. In the conventional structure in which cylindrical parts have a uniform thickness, such enhancement and improvement have a relationship of trade-off, and thus it has been difficult to achieve both thereof. The cylindrical part 32 in the present embodiment can dissolve such a relationship of trade-off owing to the simple structure in which the inner and outer edges of the cylindrical part 32 are eccentric such that the cylindrical part 32 has a varied thickness.

The deflection-position-F side of the cylindrical part 32 for the string 21 is subjected to a load caused by extending the string 21 in a tensioned state, and moreover, as the number of times a ball is hit increases, the deflection-position-F side will be more easily worn away because the string 21 repeatedly is separated from and collides with this side. In the cylindrical part 32 in the present embodiment, the first formation section 35, which forms the deflection-position-F side for the string 21, has an increased thickness, so that the durability of the portion at which the separation and collision of the string 21 occur can be increased, thereby allowing for long-term use.

In the present embodiment, the direction in which the inner face of the cylindrical part 32 (the face forming an insertion path 33) extends and the direction in which the main string 21 for forming longitudinal lines extends are parallel to each other in the longitudinal direction. Thus, the portion of the string 21 that extends from a deflection position F to the leading end of a cylindrical part 32 is substantially in line-contact with the inner face of the cylindrical part 32, while both end sides of a longitudinal line (main string 21) are supported mainly at deflection positions F. Hence, in comparison with a state in which the string 21 is extended in a tensioned state while being bent on the leading-end side of the cylindrical part 32, the length of the string 21, which is flexure-deformed upon ball hitting, can be extended approximately by the length of the cylindrical part 32, thereby enhancing the repulsive-performance. In addition, since the string 21 is substantially in line-contact with the inner face of the first formation section 35 of the cylindrical part 32, vibrations of the string 21 can be suppressed by the first formation section 35 effectively, thereby improving the feeling of ball hitting.

Since the positions at which the first formation sections 35 and the second formation sections 36 of the plurality of cylindrical parts 32 are formed are different in an alternating pattern in the direction in which the band-like part 31 extends, deflection positions F can be on the first formation sections 35 of the individual cylindrical parts 32. Accordingly, the above effects by the cylindrical parts 32 can be achieved for a plurality of longitudinal lines (main string 21) and thus for a wide range in the hitting face 22.

The main string 21 for forming longitudinal lines largely affects the repulsive-performance and the feeling of ball hitting, so the above effects can be achieved efficiently by forming first formation sections 35 and second formation sections 36 for the cylindrical parts 32 through which the main string 21 for forming longitudinal lines is inserted. In addition, the above effects can be achieved efficiently by forming first formation sections 35 and second formation sections 36 for the cylindrical parts 32 through which the string 21 passing through the central region S is inserted.

The present invention is not limited to the embodiments described above and can be implemented with various changes made thereto. The above-described embodiments are not limited to the sizes, shapes, directions, or the like illustrated in the attached drawings and can have changes made thereto, as appropriate, as long as the effect of the invention can be achieved. In addition, the invention can be implemented with changes made thereto, as appropriate, without deviating from the scope of the purpose of the invention.

For example, although the main string 21 for forming longitudinal lines and the cylindrical parts 32 through which this string is inserted are illustrated and described herein, a similar configuration can be used for the cross string 21 for forming lateral lines and the cylindrical parts 32 through which this string, which extends in the left-right direction, is inserted, simply by changing the orientation of the cylindrical parts 32 from the longitudinal direction toward the lateral direction by 90 degrees. Also in this configuration, the first formation section 35 is formed on the deflection-position-F side of the cylindrical part 32 for the string 21.

Figure 5A:
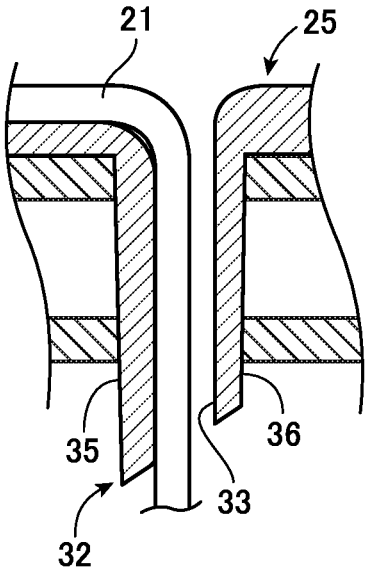
FIG. 5A is a cross-sectional view of main components of a grommet in accordance with a variation.
Figure 5B:
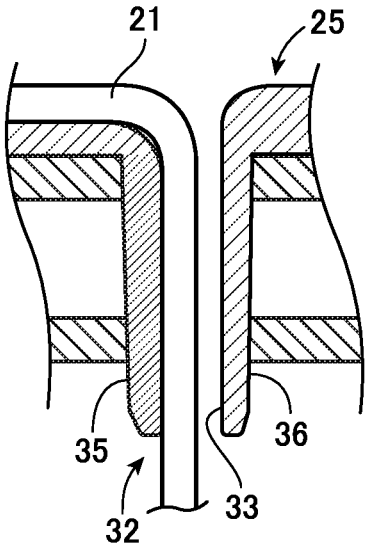
FIG. 5B is a cross-sectional view of main components of a grommet in accordance with another variation.

FIG. 5A is a cross-sectional view of main components of a grommet in accordance with a variation. FIG. 5B is a cross-sectional view of main components of a grommet in accordance with another variation. As depicted in FIG. 5A, the length of the axis line of the first formation section 35 may be different from that of the second formation section 36. In FIG. 5A, the axis line of the first formation section 35 is longer than that of the second formation section 36. However, the axis line of the second formation section 36 may be longer than that of the first formation section 35.

As depicted in FIG. 5B, the first formation section 35 and the second formation section 36 of the cylindrical part 32 may each be formed from a different material. In the configuration depicted in FIG. 5B, different resin materials are injected into a die for forming the first formation section 35 and a die for forming the second formation section 36 by using, for example, a so-called two color molding method, such that the first formation section 35 and the second formation section 36 are formed from different materials. In this way, one of the first formation section 35 and the second formation section 36 can have a relatively high rigidity, and the other can have a relatively low rigidity.

In accordance with the configuration of the cylindrical part 32 depicted in FIGS. 5A and 5B, the first formation section 35 can have a different rigidity from the second formation section 36, and the repulsive-performance upon ball hitting and feeling of ball hitting can be improved. Although the repulsive-performance or the like could be reduced in the above variations, the racket 10 can be implemented with a structure achieving a balanced overall performance owing to the ball hitting performance associated with, for example, the structures of, or the materials for, the frame 20 and the shaft 13.

Industrial Applicability

The present invention pertains to a grommet and a racket using the same, the grommet being capable of enhancing the repulsive-performance upon ball hitting with the racket and ensuring good feeling of ball hitting.

The present application is based upon Japanese Patent Application No. 2019-042725, filed on Mar. 8, 2019, the entire contents of which are incorporated herein.

The invention claimed is:

1. A racket, comprising:

a frame on which strings are extended in a longitudinal direction and a lateral direction; and a grommet, which is mounted on the frame of the racket, including a plurality of cylindrical parts, each of which is mounted in a corresponding hole formed in the frame thereof, and each of which is configured to pass a corresponding string out of the strings therethrough, wherein the strings are extended in a tensioned state on the frame and deflected at an end side of each of the plurality of cylindrical parts as a deflection position, each of the plurality of cylindrical arts includes a first formation section located on a deflection-position side with reference to a central axis position of an outer peripheral face of a respective one cylindrical part of the plurality of cylindrical parts, and a second formation section located on an opposite side of the central axis position from the first formation section, the first formation section has a thickness which is greater than that of the second formation section in a radial direction of the respective one cylindrical part of the plurality of cylindrical parts, the grommet further includes a band part that couples the plurality of cylindrical parts, positions at which the first and second formation section of each of the plurality of cylindrical parts are formed are different in an alternating pattern in a direction in which the band part extends, each of the plurality of cylindrical parts, when viewed in a direction in which a central axis thereof extends, includes a circular inner edge and a circular outer edge, and a central axis position of the circular inner edge is positioned on an opposite side of the central axis position of the circular outer edge from the deflection position, so as to form the first and second formation sections, wherein each of the strings is extended in such a way that:

each of the strings is deflected on a base section of one cylindrical part of the plurality of cylindrical parts, is inserted from a base section of the one cylindrical part of the plurality of cylindrical parts toward a leading-end thereof and is extended in a stringing direction, each of the strings having been extended in the stringing direction is inserted from a leading-end of an other cylindrical part of the plurality of cylindrical parts toward a base section thereof and is deflected on the base section thereof, and wherein the first formation section is formed on the side of the deflection position of the base section of the one cylindrical part and the other cylindrical part of the plurality of cylindrical parts.

2. The racket of claim 1, wherein the first formation section is formed from a different material from the second formation section.

3. The racket of claim 1, wherein the first and second formation sections respectively have a different length in an axis line direction of the cylindrical part.

4. The racket of claim 1, wherein the first and second formation sections are formed in each of the plurality of cylindrical parts, through which the string extended in a tensioned state in the longitudinal direction is inserted.

5. The racket of claim 4, wherein the first and second formation sections are formed in each of the plurality of cylindrical parts through which the strings passing through a central region of the frame are inserted.

* * * * *